US010006198B2

(12) United States Patent
Parsons et al.

(10) Patent No.: US 10,006,198 B2
(45) Date of Patent: Jun. 26, 2018

(54) FIBER MESH REINFORCED SHEAR WALL

(71) Applicant: Dow Global Technologies LLC, Midland, MI (US)

(72) Inventors: Gary D. Parsons, Midland, MI (US); Anthony D. Mazurowski, Bay City, MI (US)

(73) Assignee: DowGlobal Technologies LLC, Midland, MI (US)

( * ) Notice: Subject to any disclaimer, the term of this patent is extended or adjusted under 35 U.S.C. 154(b) by 0 days. days.

(21) Appl. No.: 15/103,816

(22) PCT Filed: Dec. 12, 2014

(86) PCT No.: PCT/US2014/070022
§ 371 (c)(1),
(2) Date: Jun. 10, 2016

(87) PCT Pub. No.: WO2015/094971
PCT Pub. Date: Jun. 25, 2015

(65) Prior Publication Data

US 2016/0326740 A1 Nov. 10, 2016

Related U.S. Application Data

(60) Provisional application No. 61/918,519, filed on Dec. 19, 2013.

(51) Int. Cl.

| | |
|---|---|
| ***E04C 1/00*** | (2006.01) |
| ***E04B 1/76*** | (2006.01) |
| ***E04B 2/70*** | (2006.01) |
| ***E04B 1/80*** | (2006.01) |
| ***E04B 2/56*** | (2006.01) |
| *E04B 1/24* | (2006.01) |
| *E04B 1/26* | (2006.01) |

(52) U.S. Cl.
CPC ..... *E04B 1/7654* (2013.01); *E04B 1/762* (2013.01); *E04B 1/7604* (2013.01); *E04B 1/80* (2013.01); *E04B 2/562* (2013.01); *E04B 2/70* (2013.01); *E04B 2/707* (2013.01); *E04B 2001/2496* (2013.01); *E04B 2001/2696* (2013.01)

(58) Field of Classification Search
CPC . E04B 1/7654; E04B 2/70; E04B 1/80; E04B 2/562; E04B 1/762; E04B 1/7604; E04B 2/707; E04B 2001/2496; E04B 2001/2696
USPC ..... 52/309.4, 309.9, 404.1
See application file for complete search history.

(56) References Cited

U.S. PATENT DOCUMENTS 2,009,619 A * 7/1935 Huffine ..... E04B 1/7666 156/185
2,030,157 A * 2/1936 Schlenker ..... G10K 11/172 181/30
2,055,032 A * 9/1936 Johnson ..... E04C 2/296 428/140

(Continued)

*Primary Examiner* — Basil S Katcheves

(57) ABSTRACT

Frame wall constructions are strengthened against lateral forces. A fiber mesh is applied to one side of the stick members as the wall is constructed. A rigid polymer foam is applied between the stick members. It encapsulates the fiber mesh and upon curing adheres to the stick members. No rigid sheathing material such as oriented strand board is needed to produce a frame wall construction having excellent racking strength resistance. The rigid polymeric foam also insulates and seals the structure.

11 Claims, 2 Drawing Sheets

(56) References Cited

U.S. PATENT DOCUMENTS

| | | | | | |
|---|---|---|---|---|---|
| 2,271,929 | A | * | 2/1942 | Venzie | E04B 9/001 181/284 |
| 2,745,779 | A | * | 5/1956 | Middendorff | B32B 27/00 156/252 |
| 2,780,090 | A | | 2/1957 | Rasmussen | |
| 3,619,437 | A | | 11/1971 | McDonald | |
| 4,236,361 | A | | 12/1980 | Boden | |
| 4,292,775 | A | * | 10/1981 | Howard | E04B 1/7654 52/220.1 |
| 4,885,886 | A | * | 12/1989 | Rosso | E04B 1/7658 428/140 |
| 8,793,952 | B2 | * | 8/2014 | Olang | E04B 1/7604 428/309.9 |
| 9,309,663 | B2 | | 4/2016 | Fay | |
| 2003/0041544 | A1 | | 3/2003 | Rusek | |
| 2013/0104469 | A1 | | 5/2013 | Fay | |

* cited by examiner

FIBER MESH REINFORCED SHEAR WALL

The present invention relates to a wall system for frame building construction.

Frame construction is widely used in housing and small-to-medium sized commercial buildings. Frame walls are typically made by attaching the top and bottom ends of vertical stick members (typically referred to as "studs") to horizontal members (typically called "headers" or "wall plates"). In North America, the various frame members are often wood, and are most often fastened together by nailing, gluing or stapling. The spaces between the stick members are typically at least partially filled with an insulating material to provide thermal insulation.

Building codes require frame wall systems to resist collapse under a wind load. Under a wind load, the wall facing the wind transfers the forces as a lateral racking load onto adjacent walls which support the load. The supporting walls are typically oriented more or less perpendicularly to the wall facing the wind. The supporting walls must be strong enough to withstand the applied load.

Building codes also typically regulate how the wall is insulated. A typical requirement for exterior wall is an R value of 20 $ft^2 \cdot {}^\circ$ F.·hr/Btu (3.52 $m^2 \cdot K/W$). This can be achieved, for example, by applying a 3-inch (7.6 cm) layer of 2 pound per cubic foot (32 $kg/m^3$) closed cell spray foam or R-13 or R-15 fiberglass batts in the wall spaces, together with a layer of rigid polymer foam insulation attached on the outer face of the frame wall.

It would be desirable to provide an inexpensive method for constructing a wall system that is resistant to collapse under a lateral wind load and which also exhibits good thermal insulation properties.

This invention is a frame wall structure comprising:

a) a frame comprising multiple, spaced-apart, substantially parallel stick members, the stick members defining first and second sides of the frame and wall spaces between the stick members, the wall spaces having a depth defined by the width of the stick members from said first side to said second side of the frame;

b) a fiber mesh positioned against a first side of the frame and covering the wall spaces between the stick members; and c) a rigid polymeric foam adhered to the stick members and at least partially filling the wall spaces between the stick members, the rigid polymeric foam extending out of said first side of the frame and encapsulating the fiber mesh.

This invention is a method for making a frame wall structure comprising:

a) positioning a fiber mesh against a first side of a frame comprising multiple, spaced-apart, substantially parallel stick members, wherein the stick members define first and second sides of the frame and wall spaces between the stick members, the wall spaces having a depth defined by the width of the stick members from the first side to said second side of the frame, wherein the fiber mesh covers the wall spaces between the stick members;

b) positioning a rigid backing on the first side of the frame outside of and spaced apart from the fiber mesh by a distance of 1.5 to 12 millimeters;

c) applying a liquid polymer foam composition into the wall spaces between the stick members, through the mesh and against the rigid backing to at least partially fill the wall spaces between the stick members and encapsulate the mesh, and d) curing the liquid polymer foam composition to form a rigid polymeric foam that encapsulates the fiber mesh, adheres to the stick members and at least partially fills the wall spaces between the stick members.

This frame wall structure of the invention is surprisingly resistant to lateral wind loads. The encapsulated fiber mesh has been found to provide strengthening similar to if not in excess of that provided by oriented strand board or plywood sheathing in conventional frame wall structures, at significantly lower weight and cost. With this invention, one can meet North American (or other applicable) structural codes even with two-by-four construction, without the need for oriented strand board, plywood or other rigid sheathing material. The frame wall structure is prepared easily and inexpensively, without expensive special materials or construction methods. The rigid polymeric foam produced as part of the inventive process functions as thermal insulation; therefore, according to this process, the frame wall structure is strengthened and insulated to North American (or other applicable) code requirements simultaneously. The rigid foam also can function as a sealing layer, which closes off small cracks and other openings in the frame structure. The application of the foam layer thus permits several construction steps, i.e., strengthening, insulating and crack sealing, to be performed simultaneously.

Figure 1:
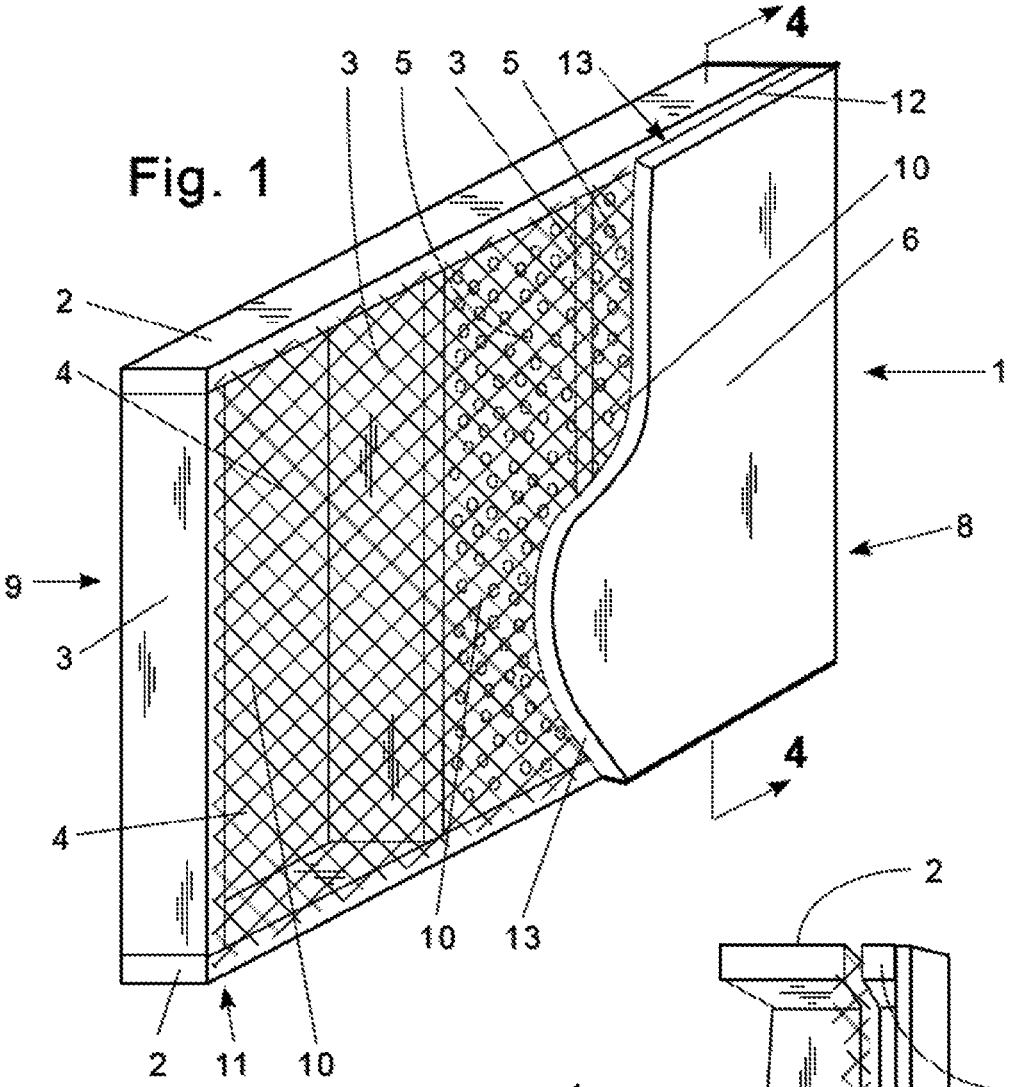
FIG. 1 is a perspective view, partially in section, of a frame wall structure of the invention.

Turning to FIG. 1, frame wall structure 1 includes a frame 11 that includes stick members 3 affixed at their ends to headers 2. Stick members 3 (and headers 2) define first side 8 and second side 9 of frame 11. The designations "first" and "second side" are chosen arbitrarily herein for convenience. The "first" side of frame 11 will ordinarily be toward the exterior of the building, but that may not always be the case. Stick members 3 and headers 2 have a width W (FIG. 2) in the direction from the first side 8 to the second side 9 of frame 11, which width W defines the depth of spaces 10 between stick members 3. The width of stick members 3 and headers 2 may be, for example, from 0.75 to 11.25 inches (19 to 286 mm). A preferred width is 3.5 to 7.25 inches (89 to 184 mm) and a more preferred width is 3.5 to 5.5 inches (89 to 140 mm). The stick members and headers may be, for example, nominal two-by-four, two-by-six, two-by-eight, two-by-ten or two-by-twelve wood, aluminum or steel members, where the numbers indicate the nominal cross-sectional dimensions of the members in inches (it being understood that actual dimensions are usually slightly smaller in commercial grade lumber due to trimming). Preferred stick members and headers are two-by-sixes and especially two-by-fours. Double or triple stick members and/or headers can be used as may be required by applicable building codes or as otherwise desired to provide greater localized strength. For example, stick members supporting a window or door frame are often required to be doubled.

Fiber mesh 4 is positioned against first side 8 of frame 11, and covers wall spaces 10 between stick members 3. Although not shown in FIG. 1, frame 11 may contain one or more openings for, and framing for, windows, doors and other features. For purposes of this invention, such openings are not part of the wall spaces between the stick members that are covered by the fiber mesh.

Fiber mesh 4 can be made of, for example, metal wires such as steel or aluminum wires, glass fibers, other ceramic fibers, carbon fibers and non-elastomeric polymeric fibers such as polyamide, polyamide-imide, polyester fibers. The wires or fibers may have diameters from, for example, 0.005 to 0.1 inch (0.127 to 2.54 mm), preferably 0.01 to 0.05 inch (0.254 to 1.27 mm), more preferably 0.01 to 0.025 inch (0.254 to 0.635 mm). The wires or fibers may be multifilament or monofilament types. The wires or fibers preferably are long types that extend across the entire surface of fiber mesh 4 in the particular direction they are oriented. The wires or fibers may be woven, knitted, entangled or bonded at intersection points to form the mesh. Fiber mesh 4 may have an open area of, for example, 25 to 80%, preferably 40 to 75% and more preferably 40 to 65%.

Figure 2:
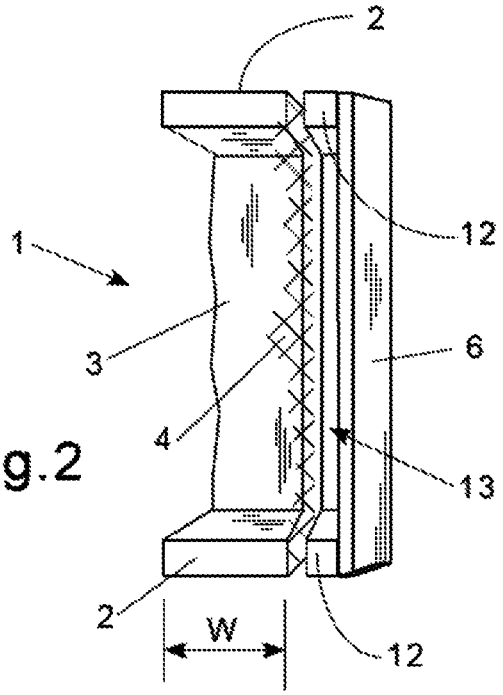
FIG. 2 is a side view, in section, of a partially assembled frame wall of the invention, prior to the application of the polymeric foam.
Figure 3:
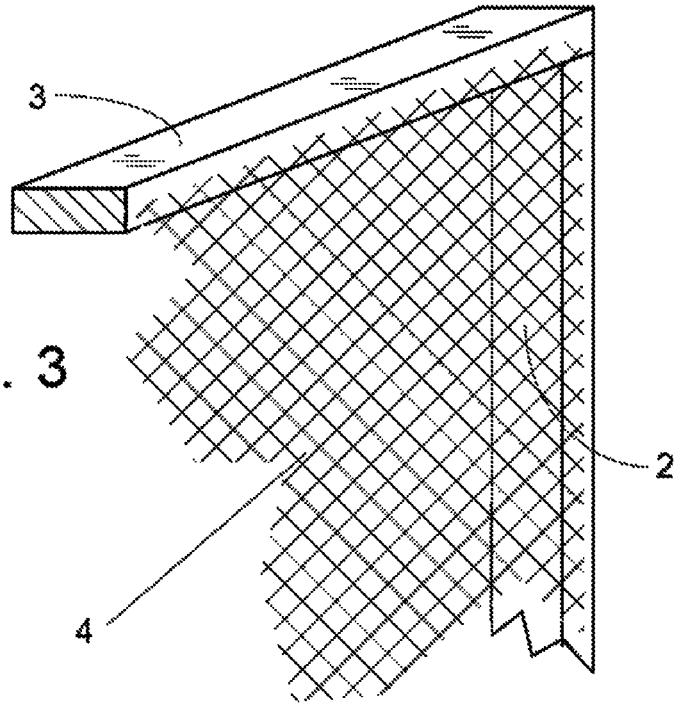
FIG. 3 is an enlarged detail of a portion of the frame wall structure of FIG. 1, showing the orientation of the fibers of the fiber mesh.

Fiber mesh 4 is preferably oriented such that the main direction of the wires or fibers forms an angle of 30 to 60 degrees to stick members 3, as is shown in the enlarged view of FIG. 3. (In each of FIGS. 2-4, the reference numerals refer to the same features as the correspondingly numbered features in FIG. 1.) This angle preferably is 40 to 50 degrees and most preferably 45 degrees. Angling fiber mesh 4 in this way has been found to further increase the strength of the frame wall structure.

During construction of the frame wall structure, fiber mesh 4 may be attached to the frame members including stick members 3 and headers 2 by stapling, nailing, gluing or other means. This attachment holds fiber mesh 4 in place during the subsequent application and curing of rigid polymer foam 5. Fiber mesh 4 should be attached snugly to the frame members, and pulled tightly enough that it rests flat against first side 8 of frame 11, but it is not necessary to tension fiber mesh 4.

After fiber mesh 4 is applied, rigid backing 6 is positioned on first side 8 of frame 11 outside of and spaced apart from fiber mesh 4 by a distance of 1.5 to 12 millimeters. This spacing is shown as gap 13 in FIGS. 1 and 2. During the subsequent application and curing of rigid polymer foam 5, rigid backing 6 functions as a mold surface which defines the outer surface of rigid polymer foam layer 5.

Generally, spacer means such as shims 12 in FIGS. 1 and 2 are positioned between fiber mesh 4 and rigid backing 6 to provide the requisite spacing. Shims 12 can be mounted continuously or discontinuously along stick members 3 and/or headers 2, as they function primarily as spacers and in most cases perform little structural function. In some embodiments, rigid backing 6 is secured to frame 11 by, for example, nailing, stapling, gluing or similar methods, before rigid polymer foam 5 is applied. This is preferred (but not necessary) if rigid backing 6 is to become part of the finished frame wall structure.

In embodiments in which rigid backing 6 becomes part of the finished frame wall structure, it may serve additional functions. Rigid backing 6 may be, for example, a thermal insulation layer such as rigid polymeric insulating foam, a sheathing or strengthening layer such as oriented strand board, particle board, plywood or other wood product, a decorative surface of various types, and so on, which become part of the finished frame wall structure. It is preferred that rigid backing 6 is something other than an oriented strand board, particle board, plywood or other wood product or, if such a material is used as rigid backing layer 6, it is removed after applying and curing the liquid polymeric foam composition. The most preferred rigid backing layer when the rigid backing layer is not to be removed from the finished frame wall structure is a rigid polymeric insulating foam.

In other embodiments, rigid backing 6 does not become part of the finished frame wall structure, i.e., rigid backing 6 is separated from finished wall structure 1 after rigid polymer foam 5 is applied and cured. In such cases, rigid backing 6 can be any rigid surface, including the types described above. The rigid backing in such embodiments may be, for example, a floor or wall surface, a wood, composite, metal or concrete plate, and the like.

Figure 4:
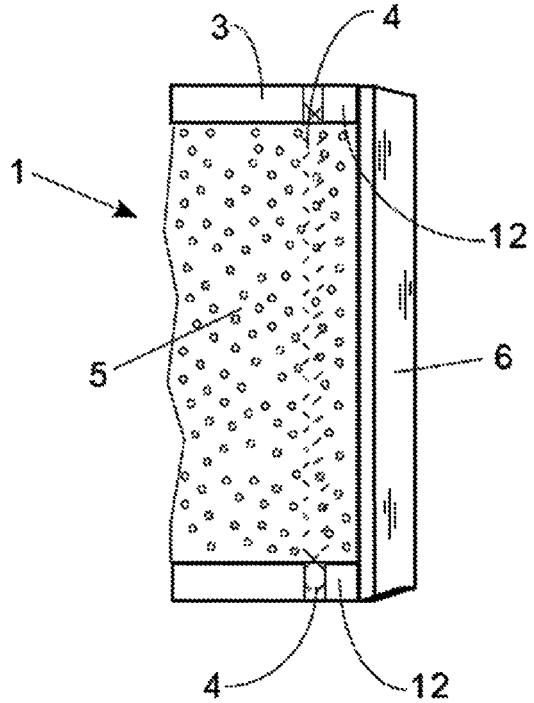
FIG. 4 is a side view, in section, of the frame wall structure of FIG. 1.

A liquid polymer foam composition is then applied into wall spaces 10 between stick members 3, through fiber mesh 4 and against rigid backing 6 to at least partially fill the wall spaces 10 between stick members 3 and encapsulate fiber mesh 4. The liquid polymer foam composition is then cured to form rigid polymeric foam 5. As shown in FIGS. 1 and 4, rigid polymer foam 5 encapsulates fiber mesh 4, adheres to stick members 3 and at least partially fills wall spaces 10 between stick members 3.

The liquid polymer foam composition is one that upon curing forms the rigid polymeric foam. The cured rigid foam preferably has a glass transition temperature of at least 30° C., more preferably at least 60° C. and still more preferably at least 90° C. as measured by differential scanning calorimetry. The polymer foam composition contains an organic polymeric component and/or polymer precursors that react to form an organic polymer. The polymer foam composition includes an entrained gas, a physical blowing agent or a chemical blowing agent that reacts or decomposes to produce a gas during the curing step.

A preferred polymer foam composition is a polyurethane-forming composition. The polyurethane-forming composition includes one or more isocyanate compounds and one or more curing agents that react with the isocyanate compound (s) to produce the polyurethane. The curing agent(s) in some embodiments include water, which reacts with isocyanate groups to generate carbon dioxide gas and chain-extend the polymer by forming urea linkage. The curing agents may also contain various polyol, polyamine and aminoalcohol compounds which react with isocyanate groups to form a polyurethane. A polyurethane-forming composition may include one or more physical blowing agents instead of or in addition to water. A polyurethane-forming composition may contain various catalysts, surfactants, colorants and other additives as may be useful.

Polyurethane spray foam insulation compositions are commercially available and are useful. Examples of these are sold by the Dow Chemical Company under the Styrofoam™ and Froth-Pak™ brand names.

Other types of polymer foam compositions are also useful. These include thermoset polymer foam composition such as epoxy resin compositions, carbon-Michael polymer foam compositions, and various foamed latex compositions. The foamed latex compositions are dispersions of high (at least 30° C., preferably at least 60° C. more preferably at least 90° C.) glass transition temperature polymer particles in a continuous liquid phase. The foamed latex compositions cure mainly by a drying rather than a polymerization mechanism, although some reaction between polymer particles may occur during of after the drying step. In each of the foregoing cases, the polymer foam composition contains entrained gas or a physical blowing agent to form the foam structure.

The polymer foam composition preferably is formulated to cure spontaneously at ambient temperatures.

The polymer foam composition can be applied by any convenient process such as spraying, pouring and the like, with spraying methods being preferred.

Enough of the polymer foam composition is applied to encapsulate fiber mesh 4 and at least partially fill spaces 10 between stick members 2. The applied polymer foam composition typically will contact rigid backing 6; in such cases, the applied polymer foam composition usually will, upon curing, form an adhesive bond to rigid backing 6 unless a release layer in applied to rigid backing 6 prior to applying rigid polymer foam 5.

The polymer foam composition is then cured in place. Curing is performed by allowing the polymer foam composition to react and/or dry, depending on the specific composition. Once cured, the rigid polymer foam encapsulates the fiber mesh and at least partially fills the spaces between the stick members. It may adhere to the rigid backing, which is preferred when the rigid backing is to be part of the finished frame wall structure.

The cured rigid polymer foam may have a foam density of 16 to 240 kg/m$^3$, more preferably 24 to 80 kg/m$^3$ and still more preferably 24 to 55 kg/m$^3$. It preferably contains at least 50%, more preferably at least 90%, closed cells. The thickness of the cured rigid polymer foam may be, for example, 0.5 to 6 inches (12.7 to 153 mm, 1.5 to 6 inches (38 to 153 mm) or 1.5 to 4 inches (38 to 102 mm).

After the polymeric foam composition has cured sufficiently to remain in place, rigid backing 6 may be removed if it is not to become part of the final frame wall structure. In an especially preferred embodiment, rigid backing 6 is a polymeric foam board insulation having a thickness of 1 to 12 (2.54 to 30.5 cm, preferably 1.5 to 4 inches (2.81 to 10.2 cm).

The frame wall assembly of the invention can be used, for example, as vertical framing members such as exterior or interior walls, horizontal framing members such as floors or ceilings, and pitched framing members such as roofs, ramps or the like. It is of particular interest as an exterior wall of a frame building.

The following examples are provided to illustrate the invention, not to limit the scope thereof. All parts and percentages are by weight unless otherwise indicated

EXAMPLES 1-4 AND COMPARATIVE SAMPLES A-D

Duplicate frames are constructed as follows: nominal two-by-four wooden studs are nailed to a two-by-four bottom plate and a two-by-four top plate using 3.5 inch (8.9 cm) framing nails. The stud spacing is 16 inches (41 cm) o.c. A second two-by-four is nailed onto the header using 3 inch (7.6 cm) framing nails to from a double top plate. The resulting frames are 8 feet (2.44 meters) tall and 8 feet (2.44 meters) wide.

To form Comparative Sample A, two 4'×8' (1.22×2.44 meter) sheets of 7/16" (11 mm) oriented strand board are nailed to one side of one of the frames, using 2 inch (5.08 cm) ring shank nails with a fastening pattern of every 6 inches (15.2 cm) on the perimeter and every 12 inches (30.4 cm) along stud lines.

To form Comparative Sample B, a coated glass fiber mesh (STO Armor Mat 15 oz/yd$^2$ (515 g/m$^2$) (white) 4×4 size) is stapled to one side of one of the frames. This glass fiber mesh has a square weave with about 4 openings per linear inch (per linear 2.54 cm). Stapling is performed using 1 inch (2.54 cm) Bostich Crown staples (1.25 inches (31 mm) in length), spaced 3 to 4 inches (7.6-10.2 cm) apart on all stud lines. The wires in the mesh are oriented 45 degrees from the stud direction.

Comparative Sample C is made in the same way as Comparative Sample B, except the glass fiber mesh is oriented with the fibers parallel and perpendicular to the stud direction.

Example 1 is made as follows: A glass fiber mesh is stapled to a frame as described in Comparative Sample B. Then, 1/8" (3.2 mm) thick wooden shims are nailed discontinuously over the fiber mesh to each of the studs, bottom plate and top plate. Two 4'×8' (1.22×2.44 meter) sheets of 1" (2.54 cm) thick extruded polystyrene foam board are then cap nailed through the shims and fiber mesh to the studs, top plate and bottom plate using 1.5" (3.8 cm) cap nails. This polystyrene foam board functions as the rigid backing layer. A 2.5 to 3 inch (6.3-7.6 cm) thick layer of a polyurethane foam formulation is then sprayed into the spaces between the studs, penetrating the fiber mesh and contacting the polystyrene foam. The polyurethane foam formulation cures to form a rigid polyurethane foam having a density of about 2 pounds per cubic foot (32 kg/m$^3$). This foam encompasses the fiber mesh and partially fills the spaces between the studs.

Example 2 is made the same way as Example 1, except the shims are (6.35 mm) thick.

Example 3 is made the same way as Example 1, except the fiber mesh is an STO standard (yellow) 6×6 glass fiber mesh. It has a square weave with about 6 openings per linear inch (per linear 2.54 cm).

Example 4 is made the same way as Example 3, except the shims are (6.35 mm) thick.

Comparative Sample D is made the same way as Examples 3 and 4, except the shim is omitted, and the polystyrene foam is attached directly on top of the fiber mesh with no gap between them.

Examples 1-4 and Comparative Samples A-D are subjected to racking strength resistance testing according to ASTM E72. The test wall frames are bolted to the bottom mounting unit of the test device with the end of the top plate(s) facing the ram. According to the ASTM test protocol, a hydraulic ram applies a measured load to an upper corner of the test wall frame, until the frame either fails or a total deflection of 4 inches (10.2 cm) is reached. The load at failure (or 4 inch (10.2 cm) deflection if no failure occurs) is measured as an indication of the strength of the test wall frame.

Results are as indicated in Table 1.

TABLE 1

| | Sample Designation | | | | | | | |
|---|---|---|---|---|---|---|---|---|
| Wall Details | A | B | C | 1 | 2 | 3 | 4 | D |
| Sheathing | OSB[1] | None | XPS[2] | XPS | XPS | XPS | XPS | XPS |
| Mesh | None | 4 × 4[3] | 4 × 4 | 4 × 4 | 4 × 4 | 6 × 6[4] | 6 × 6 | 6 × 6 |
| Mesh Orientation | N/A | 90° | 45° | 45° | 45° | 45° | 45° | 45° |

TABLE 1-continued

| Wall Details | Sample Designation | | | | | | | |
|---|---|---|---|---|---|---|---|---|
| | A | B | C | 1 | 2 | 3 | 4 | D |
| Gap | None | N/A | ⅛" | ⅛" | ¼" | ⅛" | ¼" | None |
| Rigid foam layer, in (cm) | None | None | None | 2.5-3 (6.3-7.6) | 2.5-3 (6.3-7.6) | 2.5-3 (6.3-7.6) | 2.5-3 (6.3-7.6) | 2.5-3 (6.3-7.6) |
| Racking strength resistance (force to failure, lbs (kilonewtons) | 5730 (25.5) | 122 (0.5) | 599 (2.7) | 7610 (33.8) | 7810 (35.7) | 7627 (33.9) | 7060 (31.4) | 5032 (22.4) |

Comparative Sample A represents conventional two-by-four exterior wall construction, and thus presents a baseline performance target. Comparative Sample B shows the effect of the fiber mesh alone—it is very much inferior to oriented strand board as a strengthening member.

Comparative Sample C shows the combined effect of the fiber mesh and polystyrene foam layers. The strength of this sample is about an order of magnitude less than the baseline case (Comparative Sample A).

Examples 1-4 demonstrate the surprising performance of this invention. Strengths in each case far exceed the strength of the baseline case. This data shows the effect of the combination of mesh layer and rigid foam layer. Even though the mesh layer provides little or no strengthening (Comp. B), once the rigid foam layer is applied per this invention, a very large increase in strength is achieved.

Comparative Sample D demonstrates the importance of the gap. Strength is comparable to the baseline case, but falls well short of the results of Examples 1-4.

EXAMPLES 6 AND 7

Example 6 is produced in the same general manner as Example 1 above, except the extruded polystyrene foam board is replaced with an expanded polystyrene bead foam board. Example 7 is produced in the same manner as Example 6, except a polyethylene film layer is placed on the polystyrene foam when it is attached to the frame. The polyethylene film functions as a release layer. Once the polyurethane foam is applied and cured, the polystyrene foam is removed.

On racking strength resistance testing, Example 6 fails at an applied load of 6012 pounds (27.7 kilonewtons), while Example 7 fails at 5999 pounds (27.6 kilonewtons). These results are well within the experimental error and demonstrate that the polystyrene layer in Examples 1-6 provides essentially no strengthening. The results in Examples 1-6 are therefore clearly attributable to the presence of the mesh and rigid foam layer encompassing the mesh according to the invention.

EXAMPLE 8 AND COMPARATIVE SAMPLE E

Example 8 is made in the same way as Example 1, except for the frame assembly. In this example, the frame assembly is modified by spacing the studs at 24" (61 cm) o.c., and by replacing the double top plate with a single top plate. The racking strength load at failure is 4498 pounds (20.0 kilonewtons). The lower strength compared to Examples 1-7 reflects the wider stud spacing, as is expected.

Comparative Sample E is made using an identical frame. Metal strapping (1 inch (2.54 cm) wide, 1/16 inch (1.6 mm) thick) is nailed to the frame diagonally from each corner, forming an "X". Polystyrene foam board is nailed directly to the frame over the metal strapping. No polyurethane foam layer is applied. The racking load strength of this sample is only 1563 pounds (6.95 kilonewtons).

EXAMPLE 9 AND COMPARATIVE SAMPLE F

Example 9 is identical to Example 1, except the polyurethane foam layer is only about 1 inch (2.54 cm) thick. The racking load strength of this sample is 6378 lbs (28.4 kilonewtons). This Example shows that the thickness of the rigid foam layer is not especially important to the racking strength (although greater thicknesses do lead to higher thermal insulation), so long as it encapsulates the fiber mesh.

Comparative Sample F is identical to Example 1, except the fiber mesh is omitted, and the polystyrene foam is attached directly to the frame (i.e., the shims are omitted). The racking load strength is only 3202 pounds (14.2 kilonewtons). This sample shows that the mesh is necessary to obtain strengths commensurate with conventional framing sheathed with oriented strand board.

What is claimed is:

1. A frame wall structure consisting essentially of:

a) a frame comprising multiple, spaced-apart, substantially parallel stick members affixed at their ends to headers, the stick members and headers each being nominal two inch-by-four inch, two inch-by-six inch, two inch-by-eight inch, two inch-by-ten inch or two inch-by-twelve inch wood, aluminum or steel members, the stick members and headers defining first and second side of the frame and wall spaces between the stick members, the wall spaces having a depth defined by the width of the stick members from said first side to said second side of the frame;

b) a fiber mesh positioned against a first side of the frame and covering the wall spaces between the stick members;

c) a rigid polymeric foam adhered to the stick members and at least partially filling the wall spaces between the stick members, the rigid polymeric foam extending out of said first side of the frame and encapsulating the fiber mesh; and d) a rigid backing on the first side of the frame outside of and spaced apart from the fiber mesh by a distance of 1.5 to 12 millimeters, said rigid backing defining an outer surface of the rigid polymeric foam.

2. The frame wall structure of claim 1, wherein the fiber mesh is a mesh of wires or fibers having diameters from 0.254 to 1.27 mm and has an open area of 25 to 80%.

3. The frame wall structure of claim 2, wherein the main direction of the wires or fibers of the mesh is oriented at an angle of 30 to 60 degrees from the stick members.

4. The frame wall structure of claim 2, wherein the stick members have a width of 89 to 184 mm.

5. The frame wall structure of claim 2 wherein the rigid polymeric foam has a glass transition temperature of at least 60° C.

6. The frame wall construction of claim 2 wherein the rigid polymeric foam has a thickness of 51 to 153 mm.

7. The frame wall construction of claim 2 wherein the rigid polymeric foam has a density of 24 to 80 kg/m$^3$.

8. The frame wall construction of claim 2 wherein the rigid polymer foam is a polyurethane foam.

9. The frame wall construction of claim 2, which lacks an oriented strand board, plywood or particle board sheathing layer on said first side of the frame.

10. The frame wall construction of claim 1, wherein the rigid backing is a rigid polymeric insulating foam.

11. A frame wall structure comprising:

a) a frame comprising multiple, spaced-apart, substantially parallel stick members affixed at their ends to headers, the stick members and headers each being nominal two inch-by-four inch, two inch-by-six inch, two inch-by-eight inch, two inch-by-ten inch or two inch-by-twelve inch wood, aluminum or steel members, the stick members and headers defining first and second side of the frame and wall spaces between the stick members, the wall spaces having a depth defined by the width of the stick members from said first side to said second side of the frame;

b) a fiber mesh positioned against a first side of the frame and covering the wall spaces between the stick members;

c) a rigid polymeric foam adhered to the stick members and at least partially filling the wall spaces between the stick members, the rigid polymeric foam extending out of said first side of the frame and encapsulating the fiber mesh; and d) a rigid backing comprising a rigid polymeric insulating foam on the first side of the frame outside of and spaced apart from the fiber mesh by a distance of 1.5 to 12 millimeters, said rigid backing defining an outer surface of the rigid polymeric foam c).

* * * * *